US005687581A

United States Patent [19]

Price

[11] Patent Number: 5,687,581

[45] Date of Patent: Nov. 18, 1997

[54] SPLIT-SYSTEM CONSOLE PACKAGE AIR CONDITIONING UNIT

[76] Inventor: Miller Price, 900 Colonial Dr., Morristown, Tenn. 37814

[21] Appl. No.: 642,444

[22] Filed: May 3, 1996

[51] Int. Cl.[6] ..... F25D 23/12; F25D 17/06; A47B 77/08

[52] U.S. Cl. ..... 62/263; 62/411; 312/236

[58] Field of Search ..... 62/259.1, 89, 298, 62/263, 411; 312/236, 245

[56] References Cited

U.S. PATENT DOCUMENTS

| | | | |
|---|---|---|---|
| 3,611,743 | 10/1971 | Manganaro | 62/262 X |
| 4,480,533 | 11/1984 | Bolton et al. . | |
| 4,733,543 | 3/1988 | Blair | 312/236 X |
| 5,293,758 | 3/1994 | Ames et al. | 312/236 X |
| 5,308,156 | 5/1994 | Gutierrez | 312/236 X |
| 5,404,939 | 4/1995 | Lim et al. . | |

*Primary Examiner*—William Doerrler
*Attorney, Agent, or Firm*—Carter & Schnedler, P.A.

[57] ABSTRACT

A console package air conditioning unit of the split-system type, particularly useful for retrofit conversion, but useful for new installations as well. The console package air conditioning unit is the same physical size as a self-contained package console unit being replaced, but contains essentially just an indoor heat exchanger and a blower for recirculating indoor air over the indoor heat exchanger. Being of the same physical size and having the same "footprint", the worn-out package unit is replaced without requiring any architectural changes. The left-over interior volume realized by removing the system compressor and outdoor heat exchanger to an outdoor unit is utilized as a utility storage volume, such as bookshelves. There are both a room air return opening for allowing room air to be drawn in over the indoor heat exchanger, and a ventilation opening for allowing outside air to be drawn in by a blower. The cabinet interior is subdivided into an upper plenum compartment extending substantially the entire width of the cabinet along the wall, and an indoor heat exchanger compartment occupying only a portion of the cabinet width. An air discharge opening is formed in a wall of the plenum compartment, likewise extending the width of the cabinet, and the blower pressurizes the plenum compartment. In one embodiment, a controllable damper system is provided for selectively controlling the amount of air drawn in through the room air return opening and through the ventilation opening.

19 Claims, 8 Drawing Sheets

SPLIT-SYSTEM CONSOLE PACKAGE AIR CONDITIONING UNIT

BACKGROUND OF THE INVENTION

The present invention relates generally to console package air conditioning units and, more particularly, to a split-system console package air conditioning unit for both retrofit and new installations.

A typical so-called console package air conditioning unit comprises a single cabinet containing all of the component parts of an air conditioning system needed to heat or cool a specific zone or region within a building, typically a room, such as a school classroom. The console cabinet unit is ordinarily situated next to an outdoor wall of the building, and has an outdoor air access opening through which outdoor air flows in and out via a duct which passes through a corresponding opening in the building wall.

More particularly, within the console package unit are conventional air conditioning components, such as an indoor air heat exchange coil (which functions as an evaporator coil during cooling mode and as a condenser coil during heating mode), as well as an indoor air blower for circulating indoor air over the indoor air heat exchange coil. Additionally, there are an outdoor air heat exchange coil (which functions as a condenser coil during cooling mode and as an evaporator coil during heating mode), and an outdoor air blower for circulating outdoor air over the outdoor air heat exchange coil via the outdoor access opening. The outdoor air blower draws outdoor air in through the outdoor air access opening, passes this air over surfaces of the outdoor air heat exchange coil, and discharges this air out through the outdoor air access opening. Thus, the "outdoor air heat exchange coil" is physically located within the console cabinet and within the building, but functionally is exposed to outdoor air. Correspondingly, the self-contained console package unit is physically inside the building, but functionally is divided into "outdoor" and "indoor" sections.

As the final major component, a refrigerant compressor is connected in a closed refrigerant circuit with the indoor air heat exchange coil and the outdoor air heat exchange coil, as is well known.

In addition to outdoor air drawn in through the outdoor air access opening for circulating over the outdoor air heat exchange coil, in typical installations a certain amount of outdoor air is drawn in for ventilation purposes, and mixed with indoor air circulating over the indoor air heat exchange coil. Thus, the opening in the wall of the building is sized to provide sufficient air for circulation over the outdoor air heat exchange coil, as well as for ventilation purposes.

Console package air conditioning units, like most mechanical devices, require periodic maintenance. Eventually, the components become worn-out, and the entire console package unit is replaced with an identical one. Such replacement is relatively expensive; a replacement unit typically costs $8,000.00. Moreover, replacement console package units usually are nearly identical to the unit being replaced, which may be thirty years old. The replacement units in general have not been re-designed with modern, more efficient refrigeration components.

A significant consideration in replacement applications is that the console package unit is architecturally part of the building or room within which it is installed. Thus, the unit occupies a particular floor area within the building, termed its "footprint", and the opening in the building wall for outdoor air access is sized to accommodate the outdoor air access opening of the console package air conditioning unit.

Thus, in situations where a console package air conditioning unit is replaced in its entirety, it is desirable for the replacement unit to be physically of the same size, that is, with the same "footprint" and fitting the same size wall opening, minimizing or eliminating the need for architectural changes in the room.

SUMMARY OF THE INVENTION

Accordingly, it is an object of the invention to facilitate the replacement of console package air conditioning units of the type summarized above.

It is another object of the invention to provide a relatively-low cost system for replacing console package air conditioning units.

It is yet another object of the invention to provide a system for replacing a console package air conditioning unit with a more efficient unit.

It is another object of the invention to provide a console package air conditioning unit with additional features.

Very briefly, and in overview, the invention provides a console package air conditioning unit of the split-system type, particularly useful for retrofit conversion, but having advantageous features for new installation as well. Within the indoor console unit there are essentially just an indoor heat exchanger, and a blower for recirculating indoor air over the indoor heat exchanger. The indoor console unit cooperates with an outdoor unit including a compressor and an outdoor heat exchanger, and the two units are connected via refrigerant lines.

As one significant aspect, the console package air conditioning unit of the invention is the same physical size as the original package unit, having the same "footprint", and accordingly can be used to replace a worn-out console package unit without requiring any architectural changes.

As another significant aspect, the otherwise-wasted volume within the console unit (which is relatively large since it is the same size as the unit being replaced) is configured as a utility storage volume, such as bookshelves. This configuration is especially advantageous in a classroom environment.

One advantage is cost. Thus, as noted above, to replace a console package unit with a unit of the same type costs approximately $8,000. The subject system, which employs stock standard air conditioning or heat pump components can be provided at a cost of approximately $4,000. As another significant advantage, standard air conditioning components currently available have much higher efficiencies compared to the components employed in the older console package units being replaced (and compared to the nearly identical replacement units conventionally employed). The use of such components in the split-system console unit of the invention allows an improvement in efficiency of 40% to 45% compared to conventional console package units. Further, the unit is much quieter because the refrigerant compressor is physically located outside the building.

Moreover, while a person might initially assume that the indoor unit of a "split-system" air conditioning system should be made as small as possible, since it contains basically only an indoor heat exchanger and a fan for circulating air over the indoor heat exchanger, in practice air velocity and volume requirements dictate a relatively larger unit with a correspondingly larger opening discharging conditioned air into the room. While a given heating or cooling load may be satisfied with a given air handler capacity (expressed in units of volume per interval of time), if the discharge opening is made too small, total static pressure is excessive and the resultant air velocity is relatively greater, causing excessive noise and loss of efficiency. Accordingly, it is desirable to have a relatively large area air discharge opening which handles a relatively high air flow rate (expressed in units of volume per interval of time), but with an acceptably low total static pressure and an acceptably low air flow velocity.

The invention accordingly allows a properly-sized air discharge opening to be provided in accordance with conventional design standards, desirable even in new installations where duplicating the "footprint" of a worn-out unit is not a factor, and yet provides efficient use of space through the provision of a utility storage volume.

In accordance with a more particular aspect of the invention, a split-system retrofit conversion apparatus has an indoor unit including an indoor cabinet sized so as to occupy the same floor area as the single cabinet of a worn-out self-contained package air conditioning unit and so as to cover at least the opening in the wall of the building which allows outdoor air access. The indoor cabinet typically includes a room air return opening communicating with indoor room air for recirculating over the indoor heat exchanger, and a ventilation opening corresponding with the opening in the wall of the building for bringing in outside ventilation air. A damper system may be provided for selectively controlling the amount of air drawn in through the room air return opening and through the ventilation opening to suit different seasonal operating conditions.

Also within the cabinet is an indoor air mover, such as a squirrel cage blower, for drawing room air in through at least one of the room air return opening and the ventilation opening, passing this air over surfaces of the indoor heat exchanger, and discharging air through the air discharge opening into the room.

A transition duct is connected to the ventilation opening and sized to fit the opening in the wall of the building. Since the opening in the wall of the building was originally sized for drawing in outdoor air for circulation over the outdoor air heat exchange coil, it is much larger than is required simply for ventilation. Accordingly, the ventilation opening of the retrofit conversion apparatus is smaller than the transition duct.

The interior of the indoor cabinet is subdivided into a plenum compartment extending substantially the entire width of the cabinet along the wall, and an indoor heat exchanger compartment containing the indoor heat exchanger. The air discharge opening is formed in a wall of the plenum compartment, and the indoor air mover is connected for directing air into the plenum compartment for discharge through the air discharge opening.

In a more specific aspect of the invention, the indoor heat exchanger compartment occupies only a portion of the width of the indoor cabinet, and a utility storage volume, such as bookshelves, occupies another portion of the width of the indoor cabinet adjacent the indoor heat exchanger compartment.

Preferably, the plenum compartment is located in an upper portion of the indoor cabinet above the indoor heat exchanger compartment and above the storage volume.

In addition to retrofit conversion apparatus, the invention provides a split-system console package air conditioning unit for new installations within a building along an exterior wall of the building, constructed in the same manner, and providing the same advantages, except that the consideration of architecturally matching the size of a worn-out unit being replaced is not relevant.

BRIEF DESCRIPTION OF THE DRAWINGS

While the novel features of the invention are set forth with particularity in the appended claims, the invention, both as to organization and content, will be better understood and appreciated from the following detailed description, taken in conjunction with the accompanying drawings, in which:

DETAILED DESCRIPTION

Figure 1:
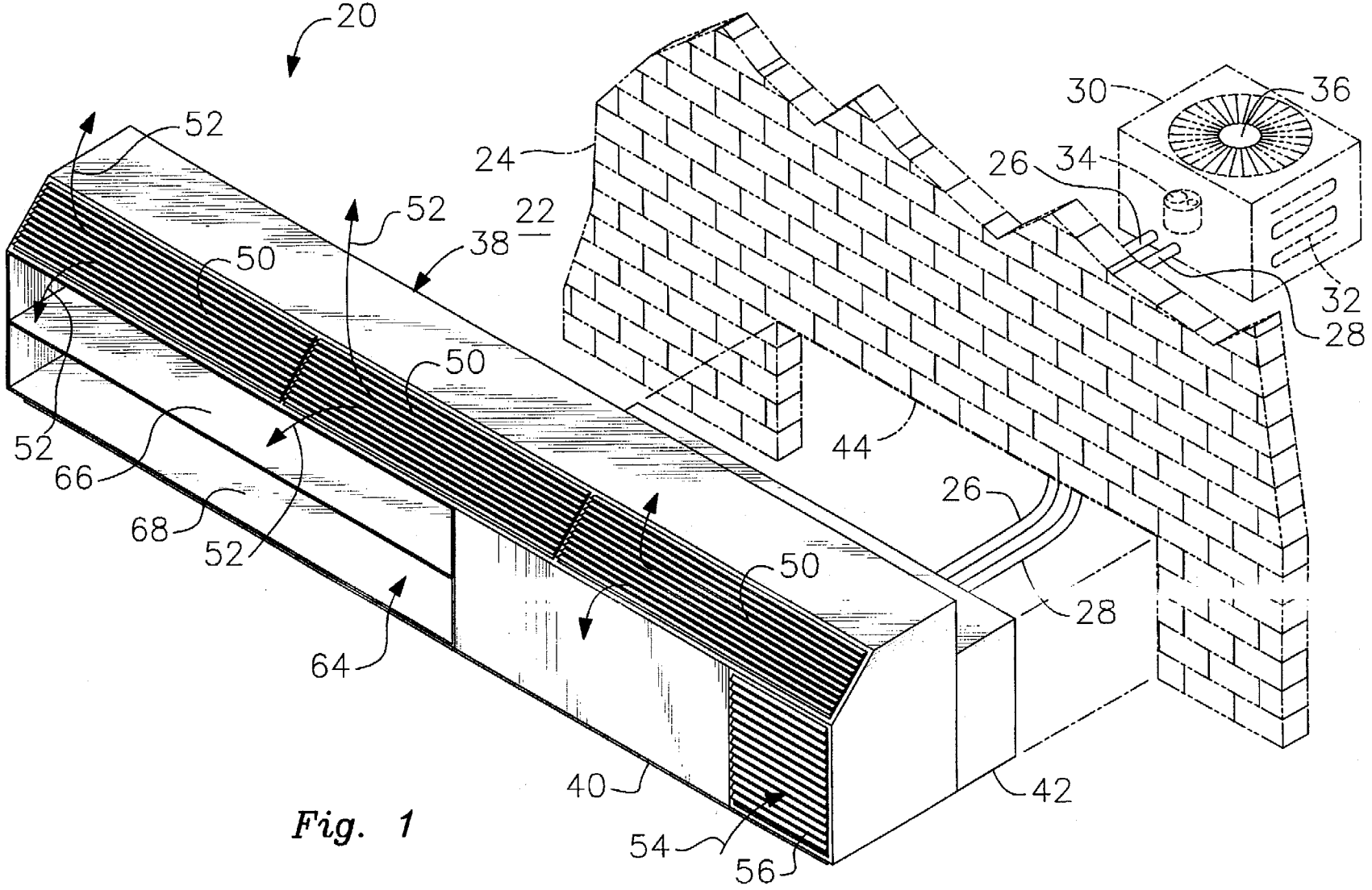
FIG. 1 is an exploded three-dimensional view of a split-system console package air conditioning unit installed within a building along an exterior wall, and connected via refrigerant lines to an outdoor unit.
Figure 2:
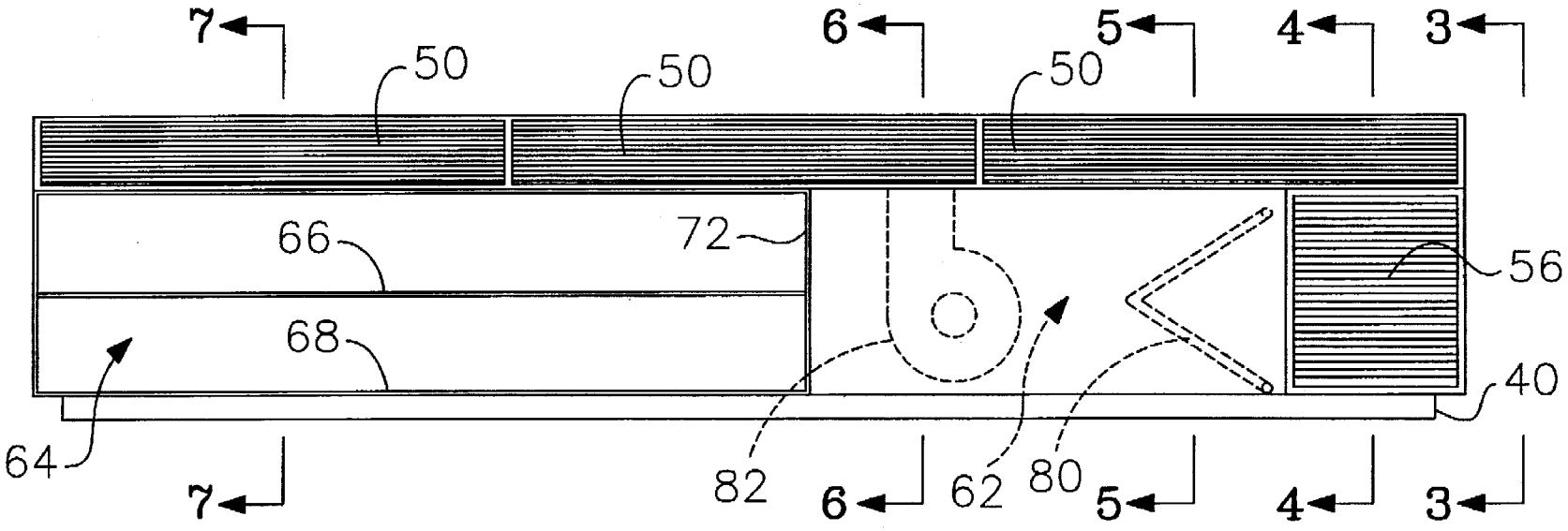
FIG. 2 is a front plan view of the split-system console package air conditioning unit of FIG. 1, showing in dash lines the relative locations of two interior components, an indoor heat exchanger and a blower.
Figure 3:
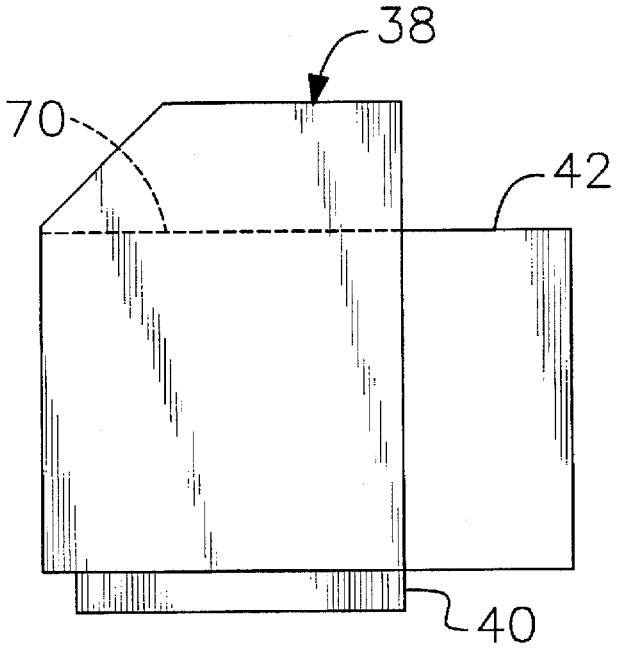
FIG. 3 is a side elevational view of the unit, taken on line 3—3 of FIG. 2.

Referring first to FIG. 1, a split-system console package air conditioning unit generally designated 20 is installed within a building represented by interior space 22 along an exterior wall 24 of the building. The console package unit 20 is connected via refrigerant lines 26 and 28 to an outdoor unit 30 including an outdoor heat exchanger 32, a system refrigerant compressor 34, and a fan 36 for circulating outdoor air over surfaces of the outdoor heat exchanger 32.

The console package air conditioning unit 20 includes an indoor cabinet 38, with a supporting base 40, and a transition duct 42, connected to the rear of the cabinet 38. The duct 42 projects through a corresponding opening 44 in the exterior wall 24 for providing access to outdoor air for ventilation purposes.

In the case of building retrofit installations, the cabinet 38 is sized so as to occupy the same floor area as the single cabinet of a self-contained package air conditioning unit, and so as to cover at least the opening 42 in the building wall 24. Typical dimensions of a retrofit cabinet 38 are 12 ft., 4½ in. wide; 2 ft., 4½ in high; and 1 ft., 10 in. depth. Various heating and cooling capacities can be provided.

In the case of a new installation, the cabinet 38 may be of any suitable size, but preferably is of similar dimensions so as to provide adequate area for the discharge of conditioned air into the room, at a suitably low total static pressure.

Thus extending substantially the entire width of the cabinet 38 is a louvered air discharge opening 50, for purposes of example comprising three subdivided sections for mechanical ridgity, and preferably located at an upper portion of the cabinet 38. Discharge air flow out of the opening 50 is represented by arrows 52. Room air, represented by an arrow 54, is drawn in through a louvered room air return opening 56. The air discharge opening 50 has an exemplary area of 12 square feet, while the room air return opening 56 has an exemplary area of three square feet.

With reference now in addition to FIG. 1, to FIGS. 2–9, the interior of the cabinet 38 is subdivided into an upper plenum compartment 60 extending substantially the entire width of the cabinet 38 along the wall 24, and an indoor heat exchanger compartment 62 which occupies only a portion of the width of the indoor cabinet 38. The remainder of the cabinet 38 width advantageously takes the form of a utility storage volume 64, illustrated as open bookshelves 66 and 68, although it will be appreciated that any desired type of storage area may be provided, such as a cabinet with doors.

Subdividing the upper plenum compartment 60 from the heat exchanger compartment 62 and storage volume 64 below is a horizontal panel 70, likewise extending substantially the entire width of the cabinet 38. Subdividing the heat exchanger compartment 62 on the right from the utility storage volume 64 on the left is a vertical panel 72 which extends from near the base of the cabinet 38 to the underside of the horizontal panel 70. In the cross-sectional views of FIGS. 4–7, the left endwall inside the upper plenum chamber 60 is visible, and is designated 74. Likewise, in the cross-sections of FIGS. 4–6, an inside surface within and at the left side of the transition duct 42 is visible, and is designated 76.

Figure 8:
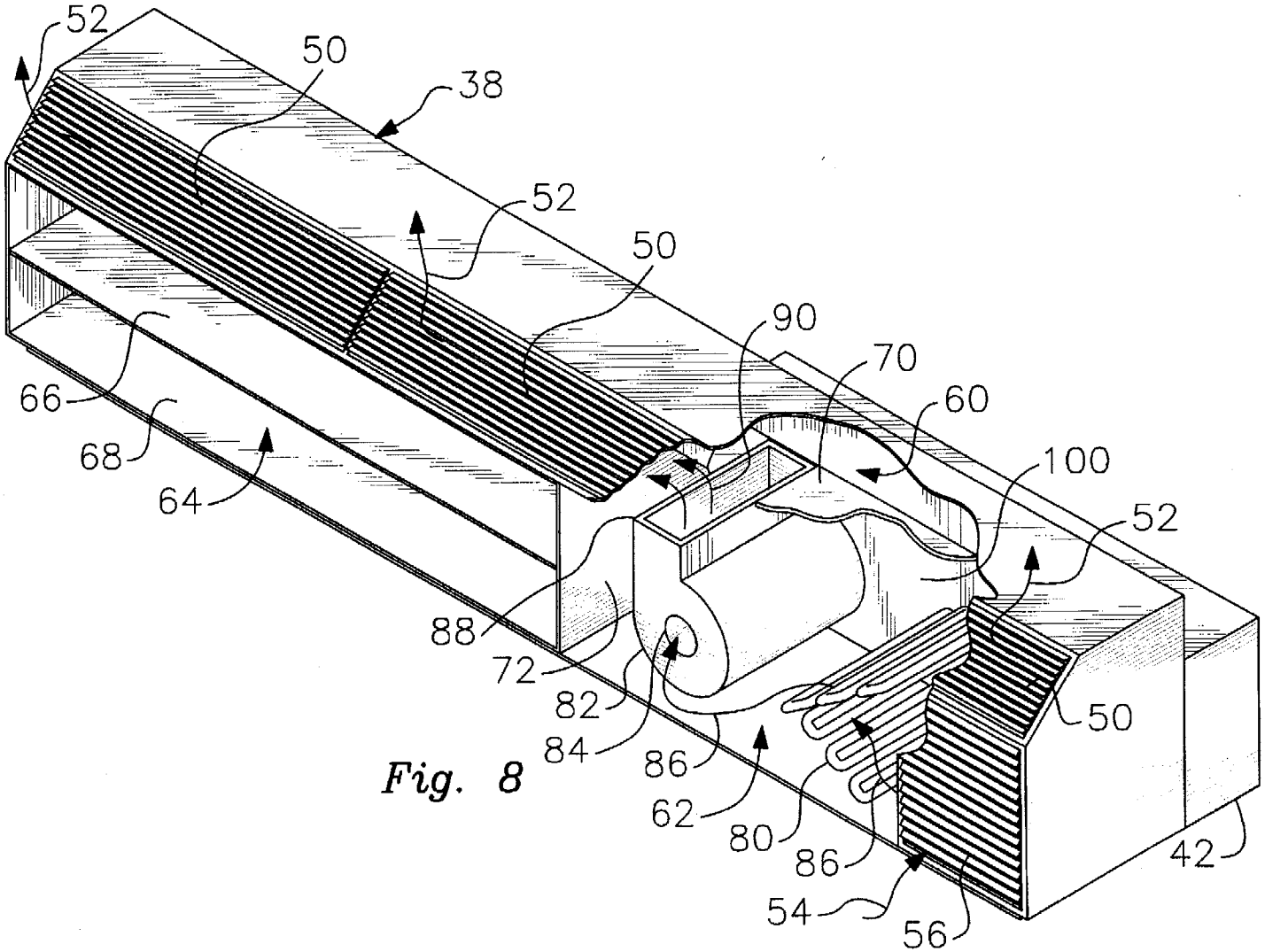
FIG. 8 is a three-dimensional view, partially cut away, showing a portion of the interior of the package air conditioning unit of FIG. 1.

Within the heat exchanger compartment 62 is an indoor heat exchanger 80, and a blower 82 which draws air over the surfaces of the indoor heat exchanger 80 into a blower inlet 84, as represented by arrows 86 (FIG. 8). A blower outlet 88 discharges air, as indicated by arrows 90 into the upper plenum compartment 60, through an aperture 92 (FIG. 6) in the horizontal panel 70. The upper plenum compartment 60 accordingly is pressurized by the blower 82, resulting in air discharge 52 into the room through the louvered openings 50.

Air flow over the indoor heat exchanger 60 is potentially drawn from two sources, the louvered room air return opening 56 drawing in room air 54, and a ventilation opening 96 (FIG. 9) through which outside air is drawn as represented by an arrow 98, via the transition duct 42.

These two air flows 54 and 98 combine, and are drawn by the blower through the indoor heat exchanger, for ultimate discharge into the room through louvered openings 50 as indicated by arrows 52.

Figure 4:
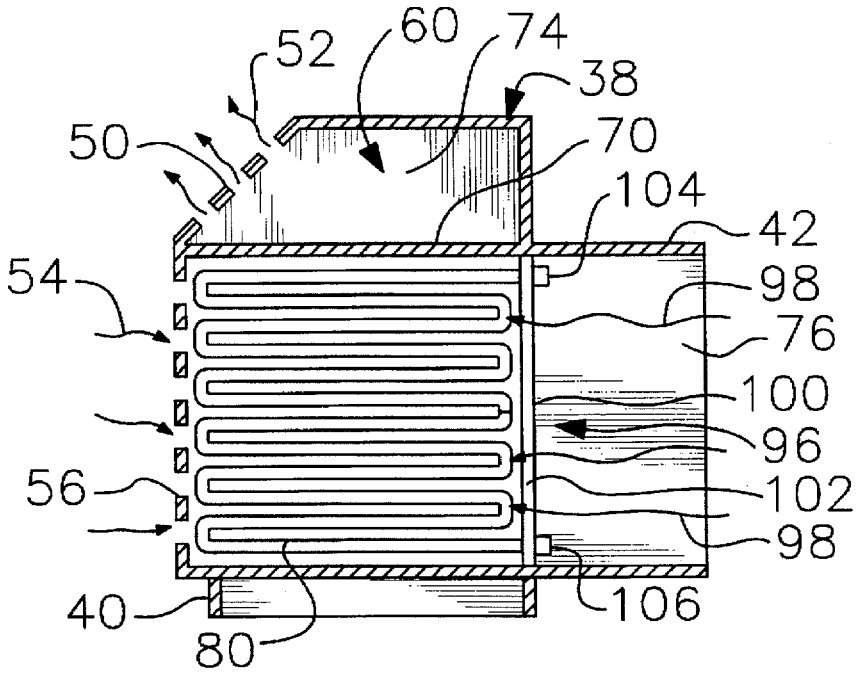
FIG. 4 is a cross-section taken on line 4—4 of FIG. 2.
Figure 5:
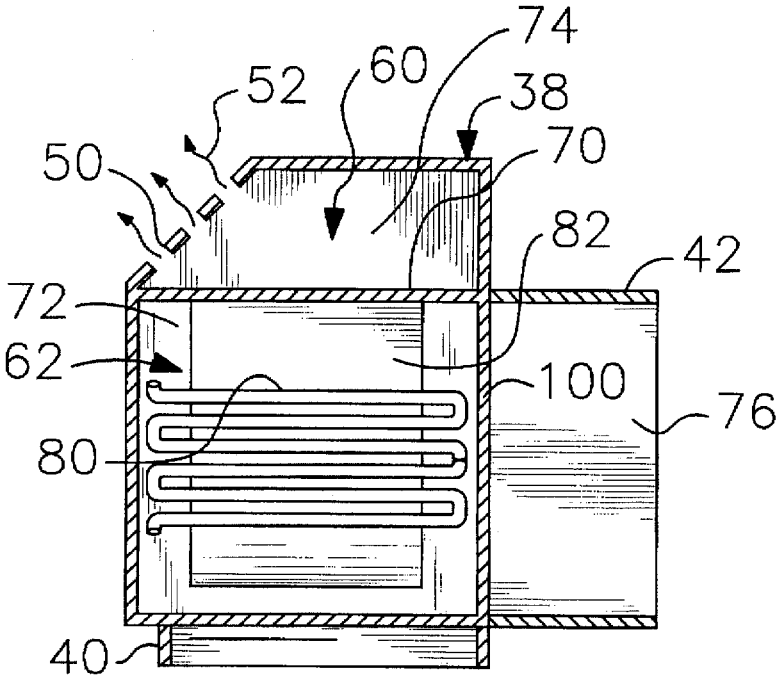
FIG. 5 is a cross-section taken on line 5—5 of FIG. 2 through the indoor heat exchanger.
Figure 6:
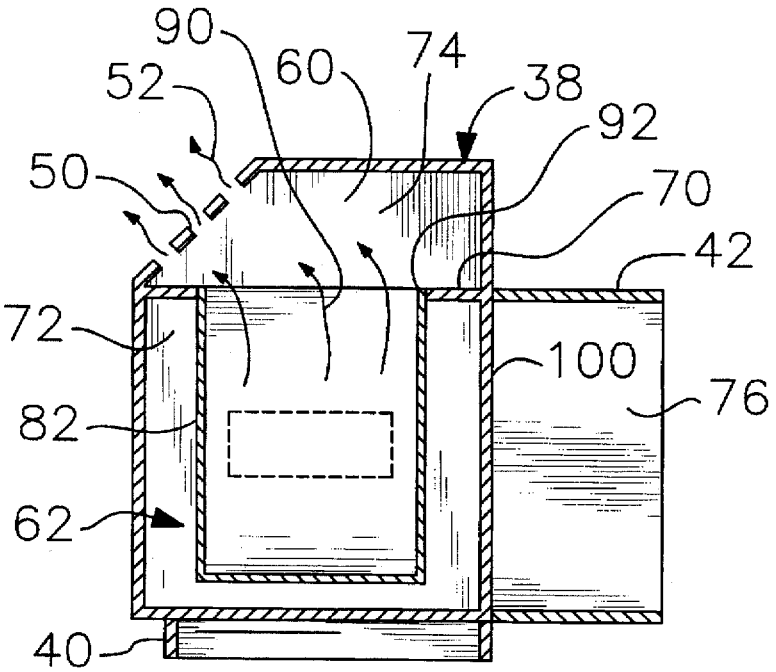
FIG. 6 is a cross-section taken on line 6—6 of FIG. 2 through the blower.
Figure 7:
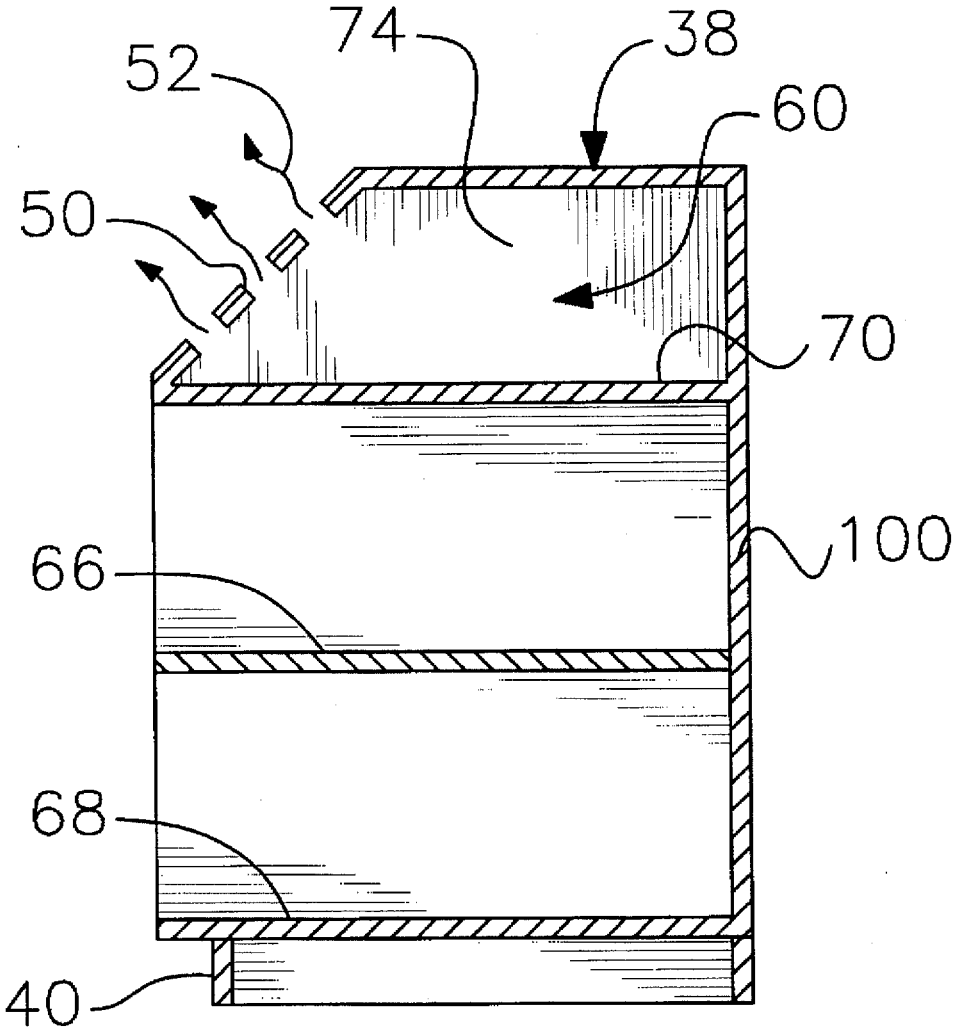
FIG. 7 is a cross-section taken on line 7—7 of FIG. 2 through the bookshelves.
Figure 9:
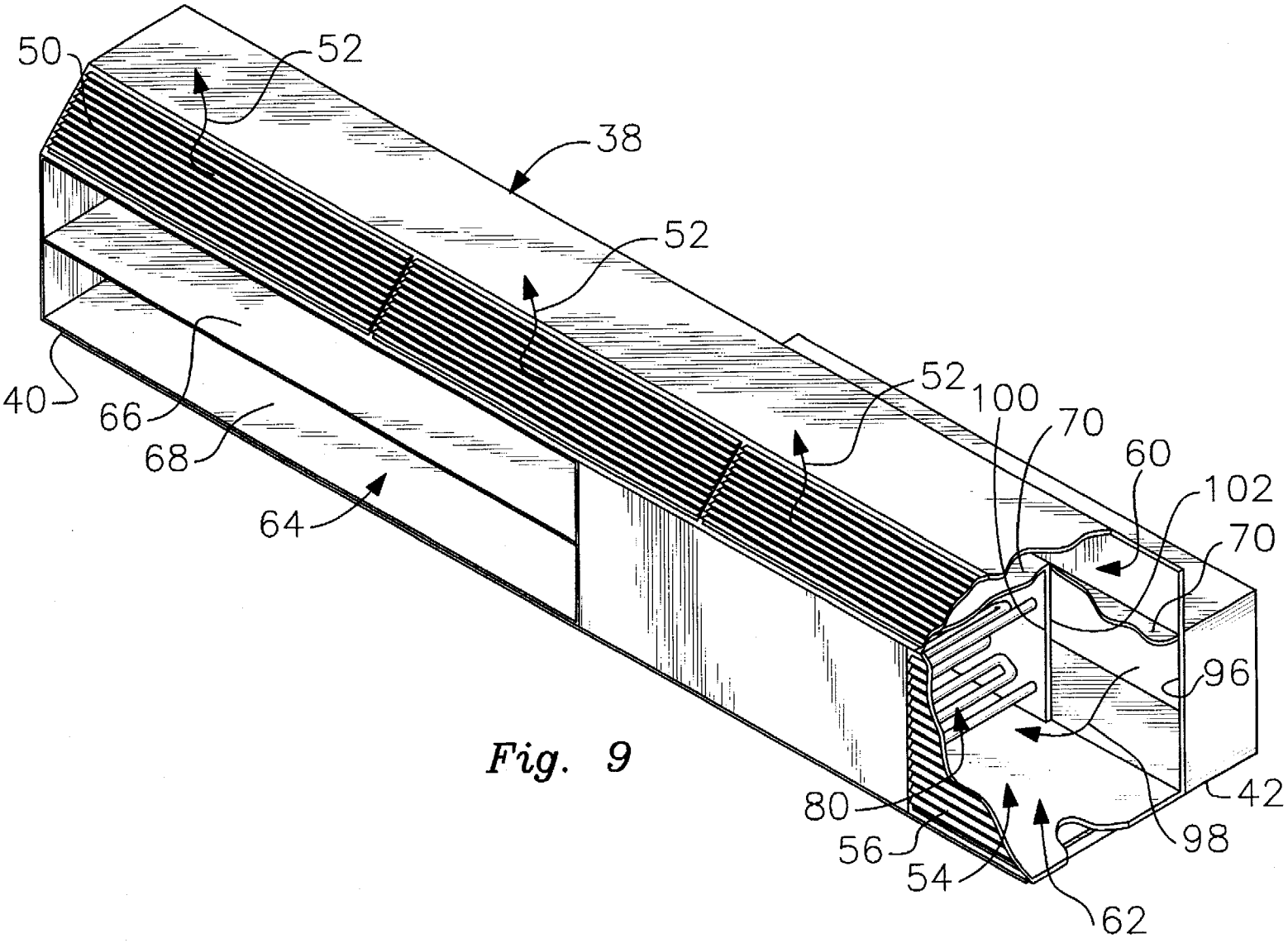
FIG. 9 is a view of the same cabinet with a different portion cut away.

The cabinet 38 has a rear wall 100 which covers nearly all of the back of the cabinet 38, except where the ventilation opening 96 is defined. In FIGS. 4 and 9, a terminating edge 102 of the rear wall 100 is visible, at the opening 96.

The transition duct 42 is sized to accommodate the existing opening 44 in the building wall 24. However, since the indoor unit 20 of the invention does not include the outdoor air heat exchange coil 32, the ventilation opening 96 is significantly smaller than the size of the transition duct 42, and accordingly most of the cross-sectional area of the transition duct 24 is blocked off by the rear wall 100.

By way of example only, apertures are provided in the rear wall 100 through which refrigerant connections 104 and 106 (FIG. 4) project for connecting the indoor heat exchanger 80 to the refrigerant lines 26 and 28, and thus to the outdoor heat exchanger 32 and system refrigerant compressor 34.

It will be appreciated that a complete system also requires a number of conventional control components which are not shown.

In the embodiment as thus far described, room air 54 is drawn in through the room air return opening 56 and outside air flow 98 is drawn in through the ventilation opening 96. It is desirable however that the relative amount of air flow drawn in through the room air return opening 56 and the ventilation opening 96 be selectively controllable. Thus, under some operating conditions, it might be desired to recirculate 100% of the room air 54, and draw no outside air in through the ventilation opening 96. At the opposite extreme, under some conditions, it is desirable to operate the unit 20 as a unit ventilator, wherein all of the air 98 is drawn from the outside through the ventilation opening 96, and no air through the room air return opening 56.

It should be noted that in some applications, such as school classrooms, the ventilation opening 96 must be at least partially open at all times.

Figure 10:
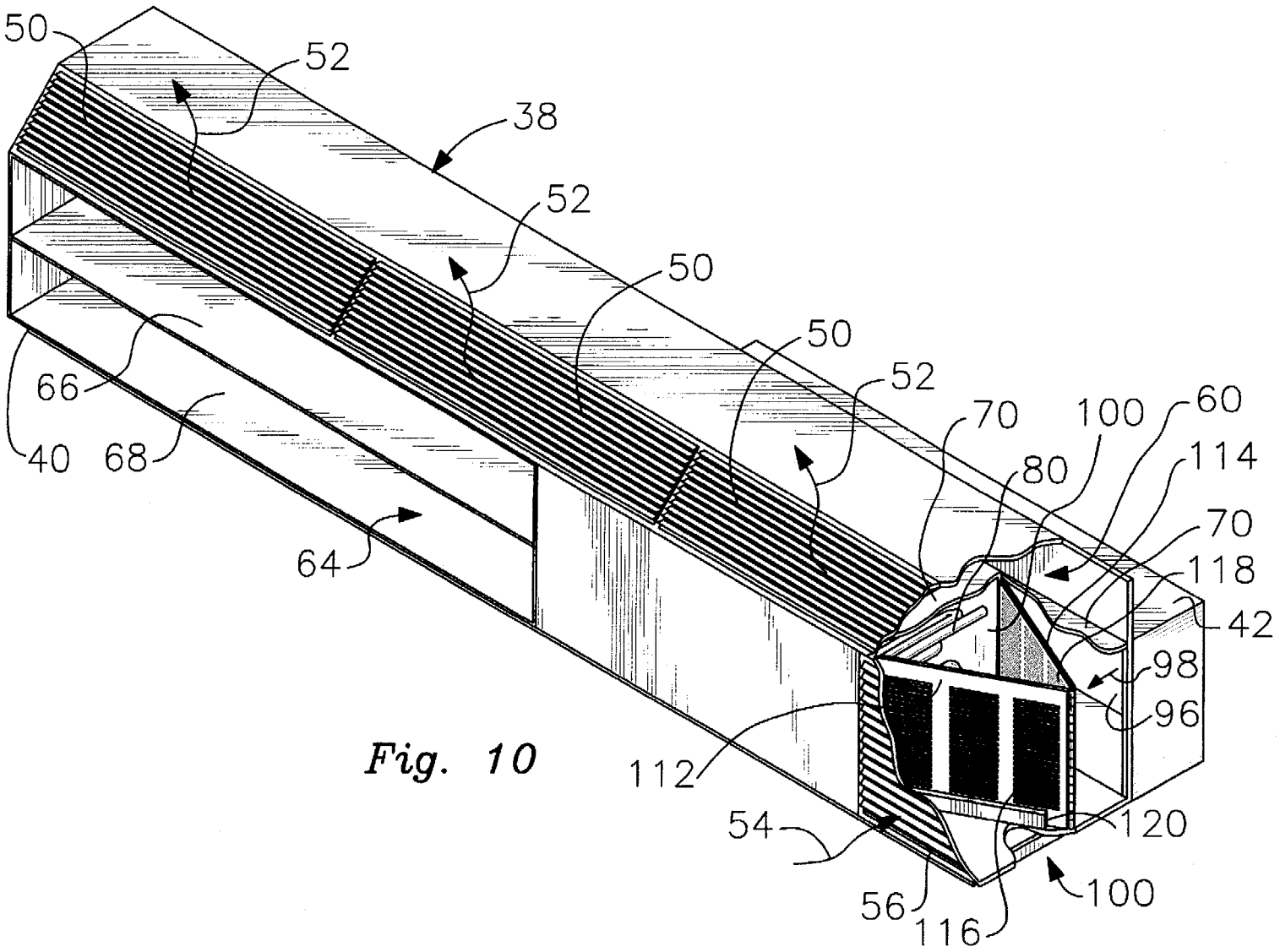
FIG. 10 is a three-dimensional view similar to FIG. 9, showing an optional controlled damper system.

While a variety of arrangements may be employed, FIG. 10 conceptually depicts one arrangement for selectively controlling the relative amount of air drawn in through the room air return opening 56 and the ventilation opening 96. Thus, in FIG. 10, there is a damper system, generally designated 110, including a pair of panels 112 and 114 having respective sets of motorized louvers 116 and 118 for controlling airflow through the respective openings 56 and 96. For purposes of example, an actuator mechanism 120 is shown connected to the motorized louvers 116.

It will be appreciated that the front motorized louvers 116 control the amount of air flow drawn in through the return opening 56, while the rear motorized louvers 118 control the amount of air flow drawn in through the room air ventilation opening 96.

In view of the foregoing, it will be appreciated that the invention provides a lower-cost way of replacing a worn-out console package heating unit, providing the advantages of a split-system using modern components, while facilitating the replacement of an older unit without requiring architectural changes in the room. In addition, the invention provides a sufficiently large room air discharge opening for acceptably low total static pressure in accordance with conventional heating and air-conditioning design standards, and utilizes the otherwise-wasted space inherent in a cabinet large enough to support the air discharge opening as a storage volume.

While specific embodiments of the invention have been illustrated and described herein, it is realized that numerous modifications and changes will occur to those skilled in the art. It is therefore to be understood that the appendant claims are intended to cover all such modifications and changes as all within the true spirit and scope of the invention.

What is claimed is:

1. Split-system retrofit conversion apparatus for replacing a self-contained package air conditioning unit of the type including within a single cabinet an indoor air heat exchange coil and an indoor air blower for circulating indoor air over the indoor air heat exchange coil, an outdoor air heat exchange coil and an outdoor air blower for circulating outdoor air over the outdoor air heat exchange coil, and a refrigerant compressor connected in a closed refrigerant circuit with the indoor air heat exchange coil and the outdoor air heat exchange coil, the self-contained package air conditioning unit being located within a building, and the single cabinet having an opening allowing outdoor air access to the outdoor air heat exchange coil through a corresponding opening in a wall of the building, and the single cabinet occupying a floor area within the building, said retrofit conversion apparatus comprising:

an indoor unit including an indoor cabinet sized so as to occupy the same floor area as the single cabinet of the self-contained package air conditioning unit and so as to cover at least the opening in the wall of the building;

said indoor cabinet being interiorly subdivided into at least a plenum compartment and an indoor heat exchanger compartment;

said indoor cabinet having at least one of a room air return opening communicating with indoor room air and a ventilation opening communicating with the opening in the wall of the building;

said indoor cabinet having an air discharge opening formed in a wall of said plenum compartment;

an indoor heat exchanger within said indoor heat exchanger compartment;

an indoor air mover within said indoor cabinet and connected to said plenum compartment for drawing room air in through said at least one of a room air return opening and a ventilation opening, passing air over surfaces of said indoor heat exchanger, and discharging air via said plenum compartment through said air discharge opening; and refrigerant line connections for connecting said indoor heat exchanger to an outdoor unit including an outdoor heat exchanger and a system refrigerant compressor.

2. The retrofit conversion apparatus of claim 1, which comprises both a room air return opening communicating with indoor room air and a ventilation opening communicating with the opening in the wall of the building.

3. The retrofit conversion apparatus of claim 2, which further comprises a damper system for selectively controlling the amount of air drawn in through said room air return opening and through said ventilation opening.

4. The retrofit conversion apparatus of claim 2, which further comprises a transition duct connected to said ventilation opening and sized to fit the opening in the wall of the building, and wherein said ventilation opening is smaller than the transition duct.

5. Split-system retrofit conversion apparatus for replacing a self-contained package air conditioning unit of the type including within a single cabinet an indoor air heat exchange coil and an indoor air blower for circulating indoor air over the indoor air heat exchange coil, an outdoor air heat exchange coil and an outdoor air blower for circulating outdoor air over the outdoor air heat exchange coil, and a refrigerant compressor connected in a closed refrigerant circuit with the indoor air heat exchange coil and the outdoor air heat exchange coil, the self-contained package air conditioning unit being located within a building, and the single cabinet having an opening allowing outdoor air access to the outdoor air heat exchange coil through a corresponding opening in a wall of the building, and the single cabinet occupying a floor area within the building, said retrofit conversion apparatus comprising:

an indoor unit including an indoor cabinet sized so as to occupy the same floor area as the single cabinet of the self-contained package air conditioning unit and so as to cover at least the opening in the wall of the building;

said indoor cabinet being interiorly subdivided into at least a plenum compartment extending substantially the entire width of said cabinet along the wall, and an indoor heat exchanger compartment;

said indoor cabinet having at least one of a room air return opening communicating with indoor room air and a ventilation opening communicating with the opening in the wall of the building;

said indoor cabinet having an air discharge opening formed in a wall of said plenum compartment;

an indoor heat exchanger within said indoor heat exchanger compartment;

an indoor air mover within said indoor cabinet and connected to said plenum compartment for drawing room air in through said at least one of a room air return opening and a ventilation opening, passing air over surfaces of said indoor heat exchanger, and discharging air via said plenum compartment through said air discharge opening; and refrigerant line connections for connecting said indoor heat exchanger to an outdoor unit including an outdoor heat exchanger and a system refrigerant compressor.

6. The retrofit conversion apparatus of claim 5, wherein said indoor heat exchanger compartment occupies only a portion of the width of said indoor cabinet.

7. The retrofit conversion apparatus of claim 6, which further comprises a utility storage volume occupying another portion of the width of said indoor cabinet adjacent said indoor heat exchanger compartment.

8. The retrofit conversion apparatus of claim 7, wherein said utility storage volume comprises book shelves.

9. The retrofit conversion apparatus of claim 5, wherein said plenum compartment is located in an upper portion of said indoor cabinet.

10. The retrofit conversion apparatus of claim 6, wherein said plenum compartment is located in an upper portion of said indoor cabinet above said indoor heat exchanger compartment.

11. The retrofit conversion apparatus of claim 7, wherein said plenum compartment is located in an upper portion of said indoor cabinet above said indoor heat exchanger compartment and above said storage volume.

12. A split-system console package air conditioning unit for installation within a building along an exterior wall of the building, said console package unit comprising:

an indoor cabinet interiorly subdivided into at least a plenum compartment extending substantially the entire width of said cabinet along the wall, and an indoor heat exchanger compartment occupying only a portion of the width of said indoor cabinet;

said indoor cabinet having at least one of a room air return opening communicating with indoor room air and a ventilation opening for communicating with an opening in the exterior wall of the building;

said indoor cabinet having an air discharge opening formed in a wall of said plenum compartment;

an indoor heat exchanger within said indoor heat exchanger compartment;

an indoor air mover within said indoor cabinet and connected to said plenum compartment for drawing room air in through said at least one of a room air return opening and a ventilation opening, passing air over surfaces of said indoor heat exchanger, and discharging air via said plenum compartment through said air discharge opening; and refrigerant line connections for connecting said indoor heat exchanger to an outdoor unit including an outdoor heat exchanger and a system refrigerant compressor.

13. The console package unit of claim 12, which comprises both a room air return opening communicating with indoor room air and a ventilation opening communicating with the opening in the wall of the building.

14. The console package unit of claim 13, which further comprises a damper system for selectively controlling the amount of air drawn in through said room air return opening and said ventilation opening.

15. The console package unit of claim 12, which further comprises a utility storage volume occupying another portion of the width of said indoor cabinet adjacent said indoor heat exchanger compartment.

16. The console package unit of claim 15, wherein said utility storage volume comprises book shelves.

17. The console package unit of claim 12, wherein said plenum compartment is located in an upper portion of said indoor cabinet.

18. The console package unit of claim 12, wherein said plenum compartment is located in an upper portion of said indoor cabinet above said indoor heat exchanger compartment.

19. The console package unit of claim 15, wherein said plenum compartment is located in an upper portion of said indoor cabinet above said indoor heat exchanger compartment and above said storage volume.

* * * * *